United States Patent [19]
Coyle

[11] 4,191,871
[45] Mar. 4, 1980

[54] PUSH-BUTTON ASSEMBLY

[75] Inventor: Forrest E. Coyle, Penn Hills, Pa.

[73] Assignee: Westinghouse Electric Corp., Pittsburgh, Pa.

[21] Appl. No.: 941,617

[22] Filed: Sep. 12, 1978

[51] Int. Cl.² ..... H01H 3/12; H01H 9/02
[52] U.S. Cl. ..... 200/159 R; 74/526; 200/303; 200/317; 200/340
[58] Field of Search ..... 200/159 R, 239, 243, 200/303, 310, 314, 317, 340, DIG. 25, 202; 74/526

[56] References Cited

U.S. PATENT DOCUMENTS 3,856,998 12/1974 Sims ..... 200/159 RX
4,017,700 4/1977 West ..... 200/340 X

*Primary Examiner*—Frederick R. Schmidt
*Attorney, Agent, or Firm*—D. R. Lackey

[57] ABSTRACT

A push-button assembly including a housing having an actuating plunger, a cover for the housing, and an electrical contact assembly mounted on the cover. Assembly of the cover on the housing orients and operatively couples the actuating plunger with the electrical contact assembly.

13 Claims, 27 Drawing Figures

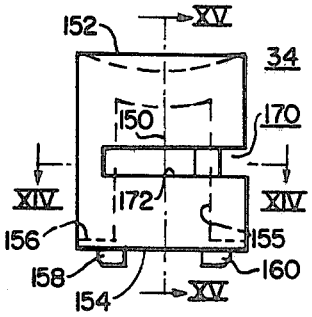
FIG.12.
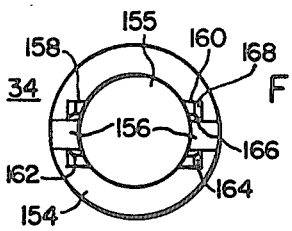
FIG.13.
FIG.23.
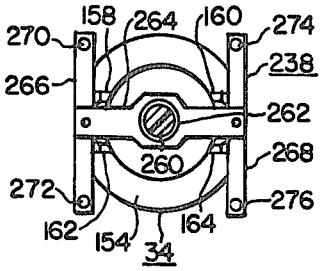
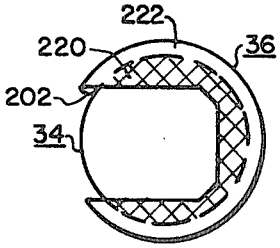
FIG.19.
FIG.11.
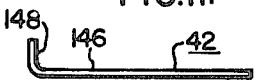
FIG.16.
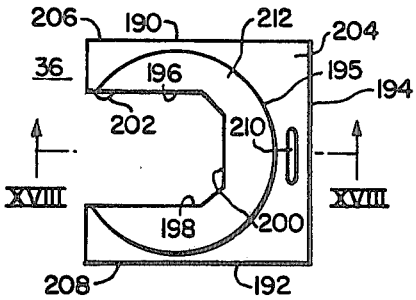
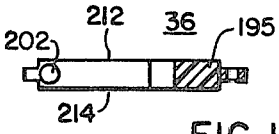
FIG. 18.
FIG.17.
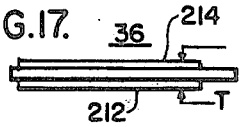
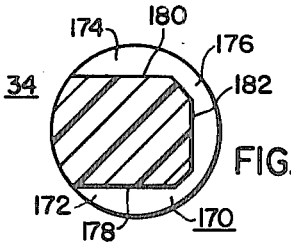
FIG.14.
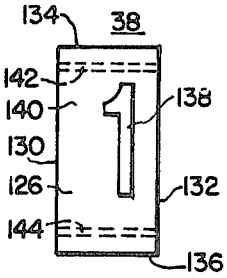
FIG.9.
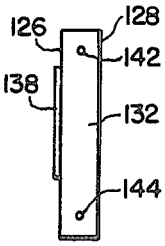
FIG.10.
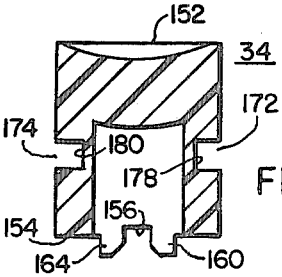
FIG.15.

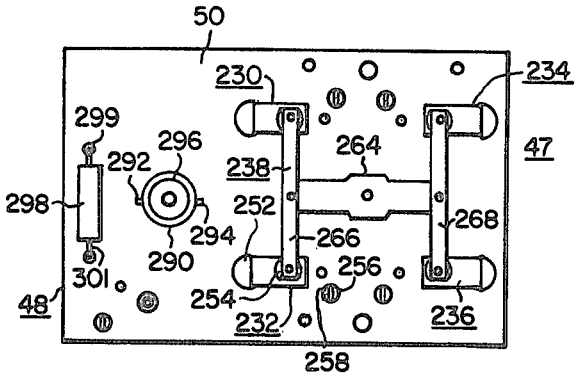
FIG. 21.
FIG. 26.
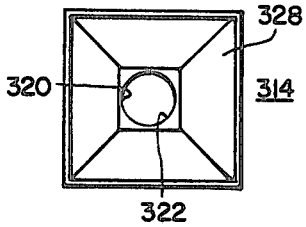
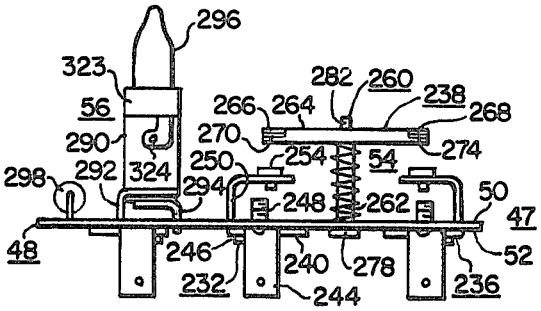
FIG. 20.
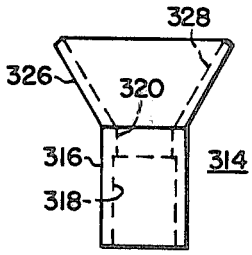
FIG. 25.
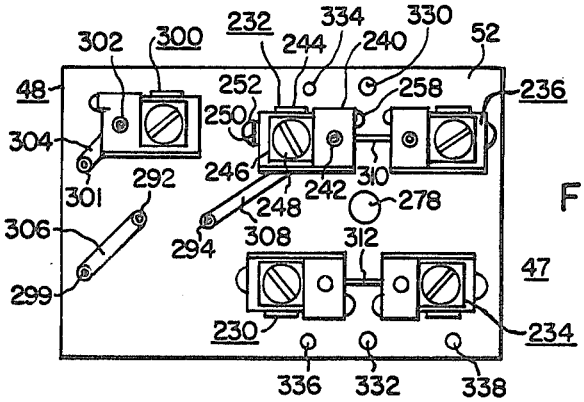
FIG. 22.

PUSH-BUTTON ASSEMBLY

BACKGROUND OF THE INVENTION

1. Field of the Invention

The invention relates to new and improved push-button assemblies.

2. Description of the Prior Art

Certain applications for push buttons are more severe than others, such as those used as elevator car call buttons in an elevator car, and elevator hall call buttons in the hallways of a building. These push buttons are subjected to constant usage by the public, and thus they must be built to withstand intense service. They are also subjected to considerable abuse, both intentional and unintentional. Thus, they must be constructed such that they do not invite vandalism, such as by eliminating visible fastening devices. Further, they must be constructed such that they will withstand abuse and vandalism, such as by being able to withstand actuation by an umbrella point, and extreme closing pressures, without external or internal damage.

Elevator push buttons have still additional requirements which set them apart from the average push button use. They must notify the sighted population that a call has been entered, by illuminating a predetermined portion of the push button after actuation, and the illumination must be maintained until the call is answered. It is also desirable to construct elevator push buttons such that they may be easily used by the visually handicapped.

In addition to reducing the number of service calls by constructing the push buttons to withstand high usage, abuse, and vandalism, they should be constructed to be easily and quickly serviced when service is necessary. For example, the light source in the push button, or any other element thereof, must be easily and quickly replaceable by authorized personnel without the necessity of using special tools.

Elevator systems are currently being constructed with conventional electromechanical relays in the control, with lower voltage solid-state devices, or with combinations of the two. It would be desirable to construct the elevator push buttons in a modular manner such that they are assembled from completely interchangeable "building blocks," enabling high voltage light sources, such as neon lamps, to be used, or low voltage light sources, such as light emitting diodes (LEDS).

Regardless of the light source utilized, the resulting push-button structure must provide adequate illumination when actuated, to notify the user that the call has been entered.

While all of the above requirements place stringent demands on the structure and design of elevator push-button assemblies, these requirements must be met with an assembly which is economically attractive, i.e., it must be easily manufactured of low cost components, and it must be susceptible to quick and accurate assembly without requiring special skills or exacting labor.

SUMMARY OF THE INVENTION

Briefly, the present invention is a new and improved push-button assembly which includes a rugged housing and an actuating plunger as one basic part of the assembly, and a back cover as the other basic part. The electrical contact assembly and illuminating means are mounted on the back cover such that assembly of the cover automatically aligns and operatively couples the actuating plunger and electrical contact assembly. Disassembly of the cover, which may be done with a screwdriver without removing the housing from its control panel, automatically decouples the actuating plunger and electrical contact assembly. If a push button becomes defective, the cover may simply be replaced with a new one, and the old one returned to a repair site for repair or disposal. Since all movable and electrical parts, except the actuating plunger, are carried by the cover, mere replacement of the cover should solve almost any malfunction.

The floor designation, or legend, is not part of the housing, but is in the form of one or more legend blocks which are quickly and easily assembled with the housing. The numbers or letters are lighted with sufficient light for the sighted population, and they are raised to permit the visually handicapped to determine which push button to actuate. The legend blocks are located adjacent to the associated button, permitting "feel" of the legend blocks without inadvertently placing a call. The actuating plunger is protected by a rugged surrounding structure which also makes it difficult to accidentally place a call, while making it easy to intentionally place a call.

The actuating plunger is secured in the housing by a rugged U-shaped stop member which limits the axial travel of the actuating plunger between two large surfaces of the housing, preventing any unnecessary stress from being placed on the electrical contact assembly. The stress from substantial actuation pressure is evenly divided between the housing and the stop member.

In addition to the placement of all of the electrical components on the cover, an attractive assembly costwise is achieved by combining several additional functions into the cover. The cover includes a printed circuit board, with all electrical connections between the contacts and circuit elements of the light source being printed on the board. Thus, the printed circuit board, in addition to keeping dust and dirt out of the assembly, functions as a lead-through insulator for electrical leads which interconnect terminals on the external side of the cover with electrical components mounted on the internal side of the cover.

Additional economies are effected through multiple use of a single biasing spring in the electrical contact assembly. The spring is given a first pre-bias during assembly of the electrical contact assembly to properly position, elevate, and stabilize the movable contact structure relative to the stationary contacts. Assembly of the cover with the housing increases the amount of pre-bias, with the additional bias being used to bias the actuating plunger to its unactuated position. Actuating the plunger to its actuated position then increases the bias still further, which bias returns the plunger to its unactuated position when the actuating force is removed.

BRIEF DESCRIPTION OF THE DRAWINGS

The invention may be better unerstood, and further advantages and uses thereof more readily apparent, when considered in view of the following detailed description of exemplary embodiments, taken with the accompanying drawings in which:

FIG. 9 is a front-elevational view of a legend block shown in FIGS. 1 and 2;

FIG. 10 is a side-elevational view of the legend block shown in FIG. 9;

FIG. 11 is an elevational view of an assembly pin used to assemble the legend block shown in FIGS. 9 and 10 with the housing shown in FIG. 3;

FIG. 12 is an elevational view of the actuating plunger shown in FIGS. 1 and 2;

FIG. 13 is an end view of the actuating end of the plunger shown in FIG. 12;

FIG. 14 is a cross-sectional view of the actuating plunger shown in FIG. 12, taken between and in the direction of arrows XIV—XIV;

FIG. 15 is a cross-sectional view of the actuating plunger shown in FIG. 12, taken between and in the direction of arrows XV—XV;

FIG. 16 is an elevational view of a stop member shown in FIG. 2, which couples the actuating plunger with the housing;

FIG. 17 is an edge view of the stop member shown in FIG. 16;

FIG. 18 is a cross-sectional view of the stop member shown in FIG. 16, taken between and in the direction of arrows XVIII—XVIII;

FIG. 19 is a diagrammatic view of the stop member and actuating plunger, illustrating how actuating stresses are uniformly divided between the actuating plunger and the housing by the configuration of the stop member;

FIG. 20 is an elevational view of the push-button cover shown in FIG. 2, illustrating how the electrical contact assembly and illuminating means are completely cover-mounted;

FIG. 21 is a plan view of the internal side of the cover shown in FIG. 20;

FIG. 22 is a plan view of the external side of the cover shown in FIG. 20, highlighting the fact that the cover includes a printed circuit board;

FIG. 23 is a cross-sectional view of the cooperative coupling arrangement between the actuating plunger and contact assembly, taken between and in the direction of arrows XXIII—XXIII in FIG. 2;

FIG. 25 is an elevational view of a reflector shown in FIG. 2, which gathers and directs the light from the illuminating means to the legend blocks;

FIG. 26 is a plan view of the reflector shown in FIG. 25; and

DESCRIPTION OF PREFERRED EMBODIMENTS

Figure 1:
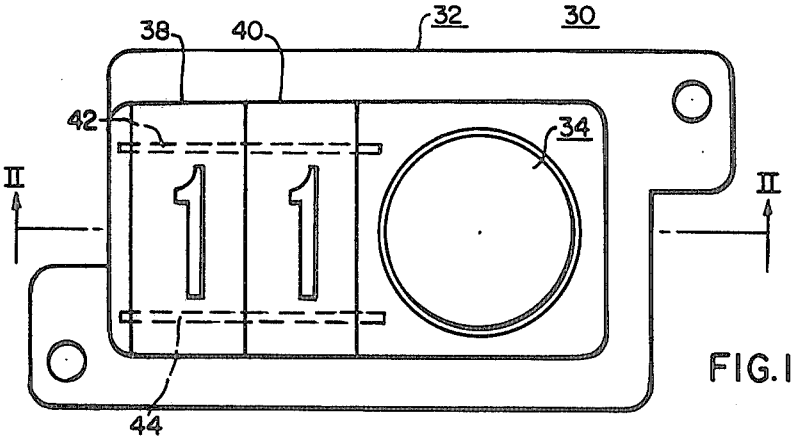
FIG. 1 is an elevational view of a push-button assembly which may be constructed according to the teachings of the invention.

Referring now to the drawings, and to FIG. 1 in particular, there is shown a push-button assembly 30 which may be constructed according to the teachings of the invention. For purposes of example, push button 30 shown in FIG. 1 is illustrated with the ornamental design shown in copending design application Ser. No. 791,369, filed Apr. 27, 1977. However, it is to be understood that the new and improved push-button assembly 30 may have any desired appearance.

Figure 2:
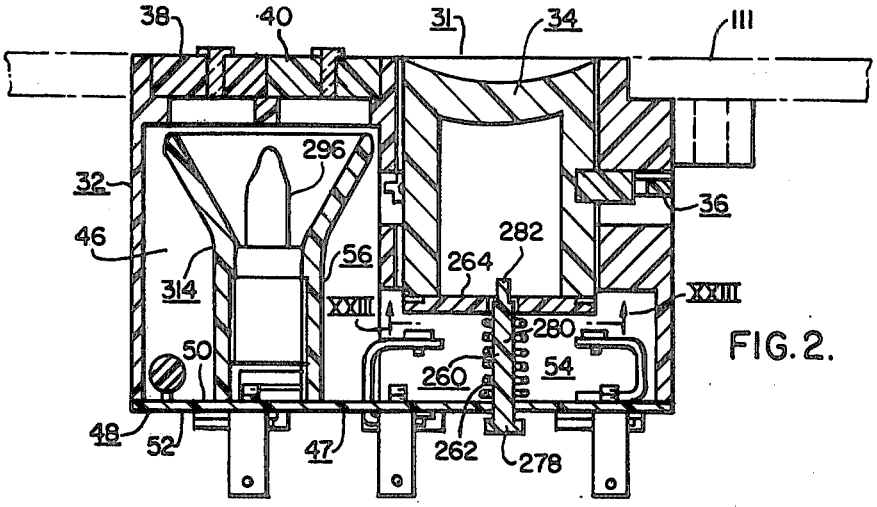
FIG. 2 is a cross-sectional view of the push-button assembly shown in FIG. 1, taken between and in the direction of arrows II—II, illustrating a push button constructed according to the teachings of the invention.

Push-button assembly 30 is shown in cross section in FIG. 2, with the section being taken between and in the direction of arrows II—II in FIG. 1. Push-button assembly 30 includes a first basic sub-assembly 31, which will also be referred to as a housing sub-assembly, with the housing sub-assembly 31 comprising a housing 32, an actuating plunger 34 carried by the housing 32 by virtue of a stop member 36, and legend blocks 38 and 40 secured to the housing 32 via pin members 42 and 44. The housing 32 defines a cavity 46.

A second basic sub-assembly 47, which will also be referred to as a cover sub-assembly 47, functions as a cover for cavity 46. The cover sub-assembly 47 comprises a printed circuit board 48 having a first major surface 50 which faces the cavity 46, and a second major surface 52 which is located outside of the cavity 46. An electrical contact assembly 54 and illuminating means 56 are mounted on side 50 of printed circuit board 48, with electrical terminals for the contact assembly 54 and illuminating means 56 being accessible on side 52 of the printed circuit board 48. The electrical contact assembly 54 is placed on printed circuit board 48 such that assembly of the cover sub-assembly 47, with the housing sub-assembly 31, automatically orients and operatively couples the electrical contact assembly 54 with the actuating plunger 34. The illuminating means 56 is placed on printed circuit board 48 such that assembly of the cover sub-assembly 47 with the housing sub-assembly 31 automatically orients and spaces the illuminating means 56 relative to the legend blocks 38 and 40, for proper back-lighting and illumination thereof. The components which make up the first and second basic sub-assemblies will now be described in detail.

Figure 7:
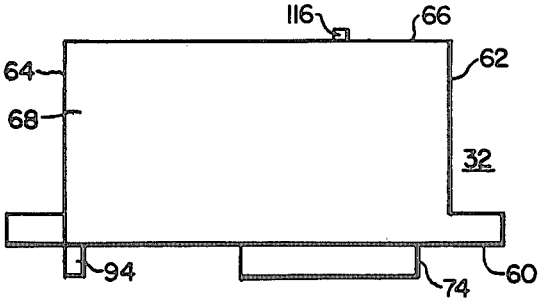
FIG. 7 is a plan view of the housing shown in FIG. 3.
Figure 5:
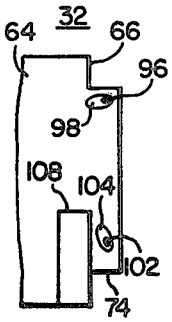
FIG. 5 is an elevational view of the left side of the housing shown in FIG. 3.
Figure 3:
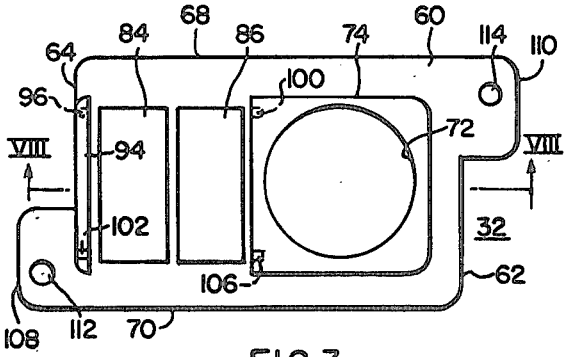
FIG. 3 is a front-elevational view of the push button housing shown in FIGS. 1 and 2.
Figure 4:
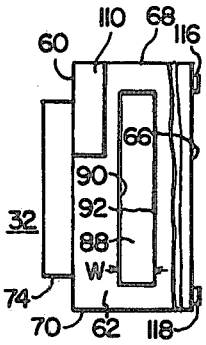
FIG. 4 is an elevational view of the right side of the housing shown in FIG. 3.
Figure 6:
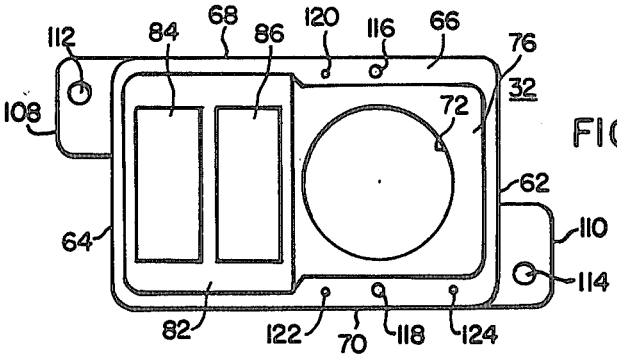
FIG. 6 is a rear-elevational view of the housing shown in FIG. 3.
Figure 8:
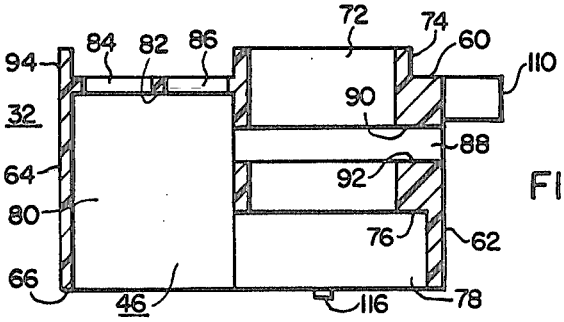
FIG. 8 is a cross-sectional view of the housing shown in FIG. 3, taken between and in the direction of arrows VIII—VIII.

FIGS. 3 through 8 are views of housing 32 shown in FIGS. 1 and 2, with FIGS. 3, 4, 5 and 6 being front, right side, left side, and rear elevational views, respectively. FIG. 7 is a top plan view of housing 32, and FIG. 8 is a cross-sectional view taken between and in the direction of arrows VIII—VIII of FIG. 3. Housing 32 includes a front portion 60, right- and left-hand side portions 62 and 64, respectively, a rear portion 66, and top and bottom portions 68 and 70, respectively.

Housing 32 defines a major cavity 46 which includes a cylindrical recess 72. Recess 72 extends from the front portion 60, with a projection 74 on the front portion 60 surrounding the end of recess 72 which is accessible from the front portion. The other end of recess 72 terminates within cavity 46 at a wall portion 76. Wall portion 76 is spaced from the rear portion 66 by a predetermined dimension. The spacing between wall portion 76 and rear portion 66 forms a sub-cavity 78 for receiving the electrical contact assembly 54 shown in FIG. 2. The cylindrical recess 72 receives the actuating plunger 34 shown in FIG. 2.

The remaining portion of cavity 46 includes a sub-cavity 80 formed between an inner surface 82 of front portion 60 and the rear portion 66, with sub-cavity 80 being sized to receive the illuminating means 56 shown in FIG. 2. Front portion 60 includes first and second openings 84 and 86 which communicate with sub-cavity 80, for providing illumination ports for legend blocks 38 and 40, respectively, shown in FIGS. 1 and 2.

Side portion 62 includes an opening which communicates with the cylindrical recess 72. Opening 88 receives stop member 36, with wall portions 90 and 92 of opening 88 cooperating with stop member 36 to provide the axial travel limits for the actuating plunger 34.

A second projection 94 extends outwardly from front portion 60, which projection is spaced from projection 74 such that projections 94 and 74 are on opposite sides of openings 84 and 86. Projection 94 has a first opening 96 therethrough, which is surrounded by a recess 98 which extends inwardly from the left-hand side portion 64 for a predetermined dimension. Opening 96 is aligned with a blind opening 100 which extends for a short distance into the side of projection 74 which faces projection 94. In like manner, projection 94 has a second opening 102 therethrough, which is surrounded by a recess 104. Opening 102 is aligned with a blind opening 106 which extends into projection 74.

Mounting tabs 108 and 110 extend outwardly from sides 64 and 62, respectively, adjacent to the front portion 60. Openings 112 and 114 in tabs 108 and 110, respectively, receive fastener hardware for securing housing 32 in a panel. A panel 111 is shown in phantom in FIG. 2. The front portion 60 would be on the back side of a panel, with the front side of a panel being flush with the forward surfaces of projections 74 and 94. Thus, the sides of the projections 74 and 94 will not be accessible from the front side of the panel, nor will the opening 88, or the rear portion 66 of the housing 32.

Alignment posts 116 and 118 project outwardly from rear portion 66, to orient the cover sub-assembly 47 shown in FIG. 2, and openings 120, 122 and 124 in rear portion 66 receive fastener hardware, such as self-tapping screws, for securing the cover sub-assembly 47 to the housing 32.

Legend blocks 38 and 40 may be of like construction, with FIGS. 9 and 10 illustrating front and side elevational views, respectively, of legend block 38. Legend block 38 has front and back surfaces 126 and 128, side portions 130 and 132, and top and bottom portions 134 and 136, respectively. The number or letter portion 138 of the legend block is formed of light transmissive material, either translucent or transparent, and the surrounding material 140 is opaque. The number or letter portion 138 extends outwardly from the front surface 126, as an aid for the visually handicapped. It will be noted from FIG. 1 that the legend blocks 38 and 40 may be contacted without registering a call, as the actuating plunger is located immediately to the right of the legend blocks, and it is flush with the projection 74, preventing accidental actuation. Each legend block defines first and second openings 142 and 144 which are disposed between sides 130 and 132, above and below the raised portion 138. When the legend blocks 38 and 40 are assembled on the front of housing 32, between projections 94 and 74, such that they smoothly and completely fill the space therebetween, their openings 142 will be aligned with openings 96 and 100, and their openings 144 will be aligned with openings 102 and 106.

The legend blocks 38 and 40 are maintained in assembled relation with housing 32 by pin members 42 and 44, shown in FIG. 1. Pin member 42 is also shown in FIG. 11. Pin member 42 may simply be a piece of wire having a predetermined length dimension, with one end thereof being bent to form a right-angle configuration having first and second leg portions 146 and 148. Leg portion 146 is the major leg, being of sufficient length to extend through all of the aligned openings 96, 142 and 100. Leg portion 148 is relatively short, being sized to enter recess 96, best shown in FIG. 5. The panel 111 covers recess 98 when push button 30 is assembled with the panel 111. If a legend block is required to be changed for some reason, the push button 30 is removed form panel 111, and a small screwdriver may be used as a lever to engage the underside of leg portion 148 of pin 42, to ease it out of the recess 98 to a point where the pin may be grasped and pulled out of the openings.

While two legend blocks 38 and 40 have been illustrated, it is to be understood that any number of legend blocks may be used. For example, one legend block dimensioned to completely fill the space between the projections 94 and 74 may be used, and it would be secured in assembled relation with housing 32 in the same manner as legend blocks 38 and 40.

FIG. 12 is an elevational view of the actuating plunger 34 shown in FIGS. 1 and 2. Actuating plunger 34 is a cylindrical member having a longitudinal axis 150 which extends between first and second ends 152 and 154, respectively. The actuating plunger 34, which may be formed of a high strength plastic, such as a polycarbonate, may be solid, or as illustrated, it may have a blind opening 155 accessible from the second end 154. End 152 is the external end, referenced to its position in the push-button assembly 30, and it is slightly concave to properly direct and center the actuating finger, for both the sighted and visually handicapped. The second end 154 is the encased end, and it includes means for cooperating with the electrical contact assembly 54 shown in FIG. 1, such that the electrical contact assembly 54 is properly aligned and supported to prevent lateral motion of the movable contact portion of the assembly. Further, the means on end 154 must automatically operatively couple the actuating plunger 34 with the electrical contact assembly when the cover sub-assembly 47 is assembled with the housing sub-assembly 31.

As illustrated in FIG. 12, and also in FIG. 13, which is an end view of the second end 154 of the actuating plunger 34, the alignment and coupling functions are provided by a groove 156 which extends across end 154, and by a plurality of projections 158, 160, 162 and 164. Projections 158 and 162 are on opposite sides of groove 156 on one side of the opening 155, and projections 160 and 164 are on opposite sides of groove 156 on the other side of opening 155. The diametrically positioned pairs of projections include chamfers, such as chamfer 166 on projection 160, which direct a portion of the electrical contact assembly 54 to the groove 156, and chamfers, such as chamfer 168 on projection 160, which direct other portions of the electrical contact assembly 54 to the surface which defines end 154. The specific cooperation between end 154 and the electrical contact assembly 54 will be hereinafter described when the electrical contact assembly 54 is described in detail.

If the actuating plunger 34 is solid, instead of being partially tubular, projections 158 and 160 may be part of a single elongated projection, as may projections 162 and 164.

Actuating plunger 34 additionally includes a slotted portion 170 intermediate its ends. Slotted portion 170 is also illustrated in FIGS. 14 and 15, which are cross-sectional views of the actuating plunger 34 shown in FIG. 12, taken between and in the direction of arrows XIV—XIV, and arrows XV—XV, respectively. Slotted portion 170 is constructed of first, second and third interconnected slots 172, 174 and 176, respectively, which have a predetermined orientation with respect to the direction of the grooves or slots 156 across the second or bottom end 154 of actuating plunger 34. Slots 172 and 174 are diametrically positioned, with the bottom surfaces 178 and 180 of the slots 172 and 174, respectively, being parallel with one another and with the direction of groove 156. Slot 176 is positioned to interconnect slots 172 and 174, with its bottom surface 182 being perpendicular to the direction of groove 156. The slotted portion 170 is used to properly orient the actuating plunger 34 about its axis 150, to prevent rotation of the plunger about its axis, and to provide means for cooperating with the stop member 36 shown in FIG. 2, which limits longitudinal movement of the plunger 34.

Stop member 36 shown in FIG. 2 is shown in detail in FIGS. 16, 17 and 18. FIG. 16 is an elevational view of a major side of stop member 36, FIG. 17 is an edge view, and FIG. 18 is a cross-sectional view taken between and in the direction of arrows XVIII—XVIII in FIG. 16. Stop member 36 has a substantially U-shaped configuration, having first and second leg portions 190 and 192, respectively, and a connecting bight portion 194. Stop member 36 includes a substantially C-shaped portion 195 which has a thickness dimension T selected to be a sliding fit with the width dimension of slotted portion 170 in the actuating plunger 34. The inner surfaces 196 and 198 of the leg portions 190 and 192, respectively, and the inner surface 200 of bight portion 194, are dimensioned and configured to contact surfaces 178, 180 and 182, respectively, of the slotted portion 170 of plunger 34. The stop member 36 may be made self-locking on the actuating plunger 34 when it is properly assembled therewith by forming the stop member of a plastic material, such as a polycarbonate, such that the leg portions may be forced slightly apart without damage to the stop member, until the leg portions reach their assembled position. While not essential, one of the leg portions, such as leg portion 190, may have a "button" 202 formed on surface 196, such that when the stop member 36 is inserted through slot 88 into the side of housing 32 to engage the actuating plunger 34, a slight pressure will be required to advance the stop member into position. When the stop member 36 reaches the assembled position, button 202 will clear the body of the actuating plunger 34 and the expanded leg portions will snap back to their unstressed positions, locking the stop member in position on the plunger 34.

As illustrated in FIG. 16, a thin flange portion 204 is included about the periphery of the main C-shaped portion 195, which is sized to cooperate with the dimensions of slot 88 in the side of housing 32, such that the stop member 36 may be placed in slot 88, with edges 206 and 208 of flange 204 cooperating with the top and bottom of slot 88 to properly orient the stop member 36 and to prevent the actuating plunger 34 from rotating about its longitudinal axis 150. The flange 204 also extends along the bight portion 194, and it may have an opening 210 sized to receive the end of a screwdriver, as an aid in removing the stop member 36 from slot 88 when it is desired to disassemble the actuating plunger 34 from the housing 32.

The difference between the thickness dimension T of stop member 36 and the width dimension W of slot 88 in the side 62 of housing 32, is selected to provide the desired axial movement of the plunger 34. The C-shaped portion 195 of stop member 36 includes first and second major opposed surfaces 212 and 214, respectively, which cooperate with the sides 90 and 92, respectively, of slot 88, to define the travel limit.

FIG. 19 is a diagrammatic view of plunger 34 and portion 195 of stop member 36, illustrating how the actuating force applied to the actuating plunger 34 is divided between substantially equal contact interface areas. The first contact interface area is between surfaces of plunger 34 and stop member 36. This contact area is the cross-hatched area 220 shown in FIG. 19. The second contact interface area is between surfaces of the stop member 36 and side 92 of slot 88 in housing 32. This area is the uncross-hatched area 222 which is radially outside of the cross-hatched area 220. It will be noted that area 220 is substantially equal to area 222, which makes the push-button assembly 30 extremely resistant to misuse and vandalism. Extreme operating pressure on actuating plunger 34 is uniformly absorbed by utilizing high strength plastic components for the housing sub-assemblies 31, such as polycarbonates for example, with only the normally required operating force being transmitted from the plunger 34 to the electrical contact assembly 54.

FIGS. 20, 21 and 22 illustrate the cover subassembly 47 shown in FIG. 2 in greater detail, with FIG. 20 being an elevational view, FIG. 21 a plan view of assembly 47 from the internal or encased side 50 of printed circuit board 48, and FIG. 22 a plan view of cover subassembly 47 viewed from the external side of the printed circuit board 48.

Basically, the cover sub-assembly 47 includes a printed circuit board 48 having a contact assembly 54 and lighting means 56 mounted thereon, such that the step of mounting the cover assembly 47 on the housing assembly 31 properly orients and operatively couples the two basic subassemblies. The printed circuit board 48 functions as a dust and dirt cover for housing 32, it is used to mount the electrical components, i.e., the electrical contact assembly 54 and lighting means 56, and it is used to mount the terminals connected to the electrical contact assembly 54 and to the lighting means 56. Further, it functions as the lead-through insulation between the terminals on side 52 of printed circuit board 48 and the electrical components mounted on side 50. Still further, it contains, in printed form, the electrical connections between the various electrical components and electrical terminals.

More specifically, the electrical contact assembly 54 includes a plurality of stationary contact members, with four stationary contacts 230, 232, 234 and 236 being shown, for purposes of example. A movable contact structure 238 completes the electrical contact assembly 54, with the movable contact structure 238 being illustrated to form two sets of normally open contacts, for purposes of example. In practice, contact assembly 54 may have one or more sets of contacts, normally open, normally closed, or both.

The stationary contacts may be of any suitable form, with a universal type of contact being illustrated. Since the stationary contacts are of like construction, only stationary contact 232 will be described in detail. Stationary contact 232 includes a base portion 240 disposed against the internal side 52 of printed circuit board 48, with base 240 being secured to board 48 with an eyelet 242. Base 240 includes a first portion 244 which extends outwardly or away from printed circuit board 48. Portion 244 is adapted to receive a slip-on type electrical terminal from an external electrical circuit. A compression plate 246 is also fastened to base 24 via screw 248, permitting a bifurcated terminal, or a flexible lead, to be secured to the base 240. Base 240 includes a second outwardly extending portion 250 which extends away from base 240 in a direction opposite to that of the first portion 244, through an opening 252 in printed circuit board 58. Portion 250 has its end bent parallel with surface 50 of printed circuit board 48, and spaced therefrom, with an electrical contact button 254 being secured thereto. Base 240 may have a third outwardly extending portion 256 which is just long enough to center an opening 258 in the printed circuit board 48. Portions 250 and 256 snugly fit their associated openings, to properly orient the stationary terminal relative to the printed circuit board 48. An additional opening (not shown) is formed through printed circuit board 48 for receiving screw 248.

The movable contact structure 238 includes a spring pin 260, a spiral spring 262, an insulative arm 264, and first and second electrically conductive, elongated bridging members 266 and 268, respectively, which carry electrical contact buttons on each end thereof. FIG. 23 is a view of the movable contact structure 238 taken between and in the direction of arrows XXIII—XXIII in FIG. 2, illustrating contact buttons 270 and 272 on bridging member 266, and contact buttons 274 and 276 on bridging member 268.

Spring pin 260, best shown in FIG. 2, has an enlarged first end 278, an intermediate portion 280, and a smaller end portion 282. Spring pin 260 is inserted through an opening in printed circuit board 48 which is sized to slidably receive the intermediate portion 280, with the pin being inserted from side 52 such that the enlarged end 278 provides a stop against side 52. The spring 262 is then telescoped over the upstanding end 282 of the spring pin 260, and the insulative arm 264 is fastened to the upstanding end of the spring pin. The insulative arm may have an opening sized to receive the small end 282 of the spring pin, with a recess formed in the side facing the printed circuit board 48 sized to receive the larger diameter of the intermediate portion 280. The insulative arm 264 may be secured on the spring pin with a press fit, and/or a suitable adhesive. When the insulative arm is pressed down against the shoulder formed between intermediate portion 280 and end 282, it compresses spring 262 with a first pre-bias which causes pin member 260 to be oriented in a vertical position relative to the major surfaces 50 and 52 of the printed circuit board 48.

FIG. 23 also clearly illustrates the cooperative coupling between end 154 of the actuating plunger 34 and the movable contact structure 238. The insulative arm 264 is directed into groove 156 in end 154 via chamfers 166 on projections 158, 160, 162 and 164, electrically conductive bridging member 266 is directed against end 154 via chamfers 168 on projections 158 and 162, and electrically conductive bridging member 268 is directed against end 154 via chamfers 168 on projections 164 and 168. If the actuating plunger 34 is solid, a central opening may be formed coaxially therein for receiving end portion 282 of the spring pin 260.

Assembly of the cover sub-assembly 47 with the housing sub-assembly 31 automatically orients the movable contact assembly 238 and it adds a second pre-bias to spring 262 sufficient to bias the actuating plunger 34 to its unactuated position shown in FIG. 2. Actuation of plunger 34 will further compress spring 262 and cause the movable contact structure 238 to engage the stationary contacts, with bridging member 266 electrically interconnecting stationary contacts 230 and 232, and with bridging member 268 electrically interconnecting stationary contacts 234 and 236. Release of the pressure on actuating plunger 34 causes spring 262 to return the movable contact structure 238 to its unactuated position.

The illuminating means 56 may include any suitable light source, such as an incandescent lamp, a neon lamp, a light emitting diode (LED), and the like. For purposes of example, a neon light source is shown. Co-pending application Ser. No. 941,610, filed Sept. 12, 1978, in the names of F. E. Coyle and A. F. Mandel, entitled "Illuminated Push Button Assembly", discloses a new and improved LED arrangement compatible with the modular design of the present application, which solves certain problems associated with the use of LED's.

More specifically, light source 56 includes a mounting base 290 mounted on side 50 of printed circuit board 48 via electrical leads 292 and 294, a neon lamp 296 mounted in base 290, a current limiting resistor 298 on side 50 of printed circuit board 48 having electrical leads 299 and 301, and a terminal 300 secured to side 52 of printed circuit board 48 via an eyelet 302. Terminal 300 may be similar to terminal 232 hereinbefore described except it does not have a portion 250.

Figure 24:
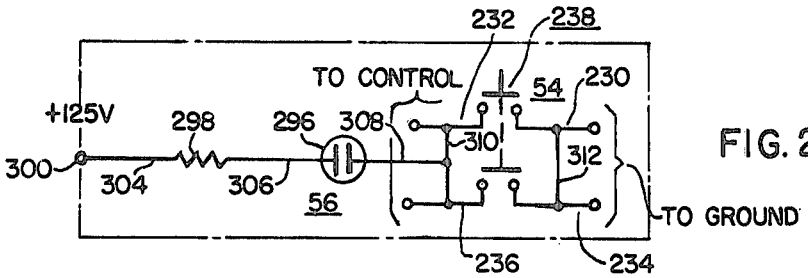
FIG. 24 is a schematic diagram of the printed circuit board shown in FIG. 22, including a representation of the components connected thereto.

The electrical leads 292 and 294 of lamp base 290 and the electrical leads 299 and 301 of resistor 298, and all of the eyelets which secure the stationary terminals 230, 232, 234, 236 and 300 to the printed circuit board 48, are all connected to the printed circuit board via plated through-holes accessible on side 52 and they are all interconnected via printed leads on side 52, as best shown in FIG. 22. Eyelet 302 of terminal 300 is connected to lead 301 of resistor 298 via printed circuit lead 304, lead 299 of resistor 298 is connected to lead 298 of lamp base 290 via printed circuit lead 306, lead 294 of lamp base 290 is connected to eyelet 242 and thus to terminal 232 via printed circuit lead 308, stationary terminals 232 and 236 are interconnected via printed circuit lead 310, and stationary terminals 230 and 234 are interconnected via printed circuit lead 312. FIG. 24 is a schematic diagram of the electrical circuit of the push-button assembly 30, illustrating that terminal 300 is adapted for connection to a source of electrical potential, that terminals 230 and 234 are adapted for connection to ground, and that terminals 232 and 236 are adapted for connection to the elevator control circuits. Neon lamp 296, once illuminated by placement of a call, remains illuminated via the control circuits until the call is answered.

FIGS. 25 and 26 illustrate a reflector 314 formed of a suitable plastic, which may be placed over lamp 296 and lamp base 290, to collect and direct the light from lamp 296 directly on the back side of the legend blocks 38 and 40. Reflector 314 includes a base 316 having a first opening 318 for snugly receiving the lamp base 290, and a second opening 320 in communication with the first opening, which is sized to receive the base 323 of the lamp 296. Opening 320 includes an enlarged portion 322 on one side thereof sized to accommodate the locking projection 324 on the side of the lamp base 323. Projection 324 thus functions to properly orient reflector 314 and prevent it from rotating about its longitudinal axis. A flared upper portion 326 has four sloping sides, the internal surfaces of which are coated with a white paint to contain the light within the flared portion and reflect the light towards the legend blocks. The four sides, such as side 328, form an angle of about 60 degrees with a horizontal plane.

The printed circuit board 48 includes openings 330 and 332 for receiving projections 116 and 118 on housing 32, and openings 334, 336 and 338 which cooperate with openings 122, 124 and 126, respectively, on the back 66 of housing 32, for receiving fastener devices, such as screws.

Figure 27:
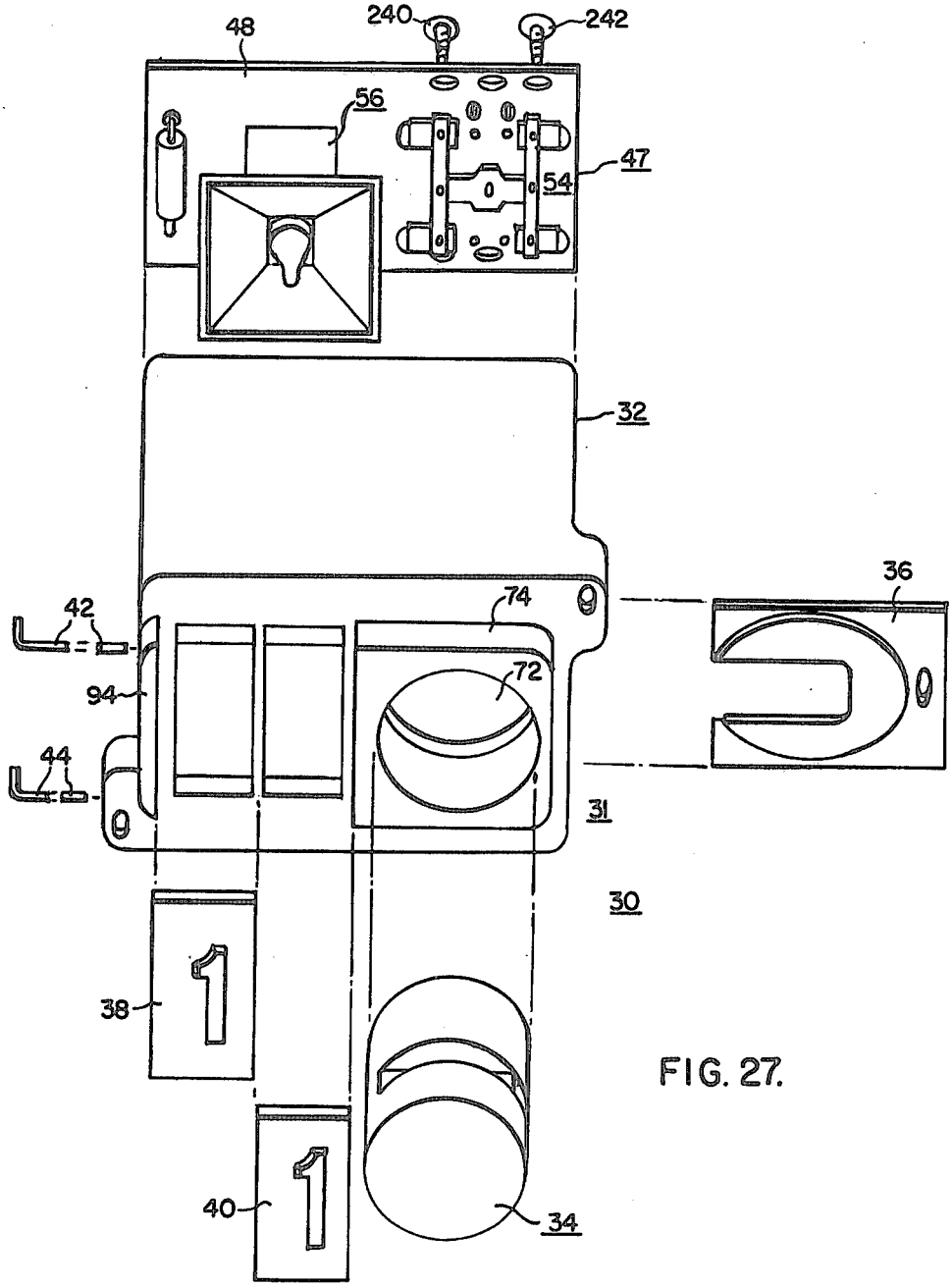
FIG. 27 is an exploded perspective view of the push-button assembly shown in FIG. 1, illustrating the ease of assembly of the various components thereof.

FIG. 27 is an exploded perspective view of push-button assembly 30 shown in FIG. 1, illustrating the simple assembly and disassembly procedure which the invention enables. Legend blocks 38 and 40 are pinned into position between projections 94 and 74 via pins 42 and 44, the actuating plunger is inserted into cylindrical recess 72 and stop member 36 is inserted into slot 88, to secure plunger 34 in the housing with the proper orientation about its longitudinal axis, while allowing a predetermined longitudinal movement, and no rotational movement about the longitudinal axis. The cover subassembly 47 is then secured to the housing subassembly 31 via a plurality of screws, such as screws 240 and 242. The step of securing the cover sub-assembly 47 automatically aligns and operatively couples plunger 34 with the electrical contact assembly 54. The assembly step also automatically aligns the illuminating means 56 with the legend blocks 38 and 40. Relamping only requires that the cover sub-assembly 47 be removed by removing the screws. The illuminating means 56 comes out of the cavity along with the printed circuit board 48, making it a simple matter to change lamps. If a malfunction is not due to the lamp, and it is not immediately apparent, the whole cover sub-assembly 47 may simply be replaced with a spare, and the old one returned to a service site for repair or disposal. The housing subassembly 31 is a rugged, vandal-resistant structure which should not require service because the spring, lamp, and electrical contacts, are all mounted on the printed circuit board 48. Should a component of the housing assembly 31 become damaged, or should the legend blocks require a new legend, replacement of any component may be quickly achieved simply by removing the housing assembly 31 from the associated panel. A screwdriver will quickly release either the pins 42 and 44, or stop member 36, or both, as required, from the assembly, for quick replacement of any component thereof.

I claim as my invention:

1. A push-button assembly, comprising:

a housing having a cavity, and recess which communicates with the cavity, an elongated actuating member having first and second ends, and a longitudinal axis which extends therebetween, means mounting said actuating member for movement in said recess, said mounting means orienting the actuating member to a predetermined position about its longitudinal axis while preventing rotation of the actuating member about said longitudinal axis, a cover mounted on said housing to cover the cavity therein, and an electrical contact assembly mounted on said cover, within the cavity of said housing, said electrical contact assembly being located on said cover in a predetermined position selected such that assembly of said cover on said housing orients it with said actuating member, said electrical contact assembly including stationary contacts fixed to the cover, a movable contact structure, a pin member having first and second ends, a stop member, and a spiral spring member, said pin member being disposed through an opening in the cover with its first end outside of the cavity, said stop member being fixed to the first end of said pin member, and said movable contact structure being fixed near the second end of said pin member, with said spiral spring being disposed about said pin member, between the cover and said movable contacts, said electrical contact assembly and said actuating member being cooperatively configured such that assembly of said cover on said housing operatively couples said actuating member and said electrical contact assembly, with the second end of the actuating member including alignment means which cooperate with said movable contact structure to orient and provide lateral support therefor, when the cover is assembled with the housing.

2. The push-button assembly of claim 1 wherein the alignment means on the second end of the actuating member includes projections cooperable with the movable contact structure for aligning the movable contact structure with the associated stationary contacts when the cover is assembled with the housing.

3. A push-button assembly, comprising:

an actuating member, said actuating member being substantially cylindrical, having first and second ends, a longitudinal axis between its ends, and first and second grooves intermediate its ends disposed on opposite sides of the actuating member which extend perpendicular to the longitudinal axis, a housing having a cavity, a recess which communicates with the cavity, and a slot which communicates with the recess, means mounting the actuating member for movement in the recess including a substantially U-shaped stop member disposed in the slot in the housing, said stop member having a bight portion, and first and second spaced leg portions, said first and second leg portions engaging the first and second grooves, respectively, in the actuating member, to orient the actuating member about its longitudinal axis and prevent rotation thereof about said axis, said stop member limiting the axial movement of the actuating member to that determined by the difference between the widths of the slot and the stop member, measured in the axial direction of the actuating member, a cover mounted on said housing to cover the cavity therein, and an electrical contact assembly mounted on said cover, within the cavity of said housing, said electrical contact assembly being located on said cover in a predetermined position selected such that assembly of said cover on said housing orients it with said actuating member, said electrical contact assembly and said actuating member being cooperatively configured such that assembly of said cover on said housing operatively couples said actuating member and said electrical contact assembly.

4. The push-button assembly of claim 3 including a third groove in the actuating member which joins and is perpendicular to the first and second grooves, with the bight portion of the stop member engaging said third groove.

5. The push-button assembly of claim 3 wherein the stop member is self-locking on the actuating member, requiring slight separation of the first and second leg portions to disengage the stop member from the actuating member.

6. The push-button assembly of claim 3 wherein the stop member is configured such that the contact area between the actuating member and the stop member is substantially equal to the contact area between the stop member and a side of the slot in the housing.

7. A push-button assembly, comprising:

a housing having a cavity, a recess which communicates with the cavity, a front portion, with said recess extending to said front portion, a first projection surrounding the recess, and a second projection on the front portion of the housing, spaced from the first projection, at least one legend block disposed in the space between first and second projections, mounting means for the at least one legend block including at least one elongated member which extends through aligned openings in the first and second projections and at least one legend block, an actuating member, means mounting said actuating member for movement in said recess, a cover mounted on said housing to cover the cavity therein, and an electrical contact assembly mounted on said cover, within the cavity of said housing, said electrical contact assembly being located on said cover in a predetermined position selected such that assembly of said cover on said housing orients it with said actuating member, said electrical contact assembly and said actuating member being cooperatively configured such that assembly of said cover on said housing operatively couples said actuating member and said electrical contact assembly.

8. The push-button assembly of claim 7 wherein the front portion of the housing includes an opening behind the at least one legend block which communicates with the cavity, and including illuminating means mounted on the cover, within the cavity, such that assembly of the cover with the housing orients said illuminating means with the opening behind the at least one legend block.

9. The push-button assembly of claim 8 including two legend blocks disposed in the space between the first and second projections, with the elongated member of the mounting means extending through aligned openings in the first and second projections and the two legend blocks.

10. A push-button assembly, comprising:

a housing having a cavity, a front portion, a recess which extends from the front portion to the cavity, and a slot which communicates with the recess, an electrical contact assembly in the cavity, and an actuating member in the recess operatively coupled with said electrical contact assembly, said actuating member being substantially cylindrical, having first and second ends, a longitudinal axis between its ends, and first and second grooves intermediate its ends disposed on opposite sides of the actuating member which extends perpendicular to the longitudinal axis, and means mounting the actuating member in the recess including a substantially U-shaped stop member disposed in the slot in the housing, said stop member having a bight portion, and first and second spaced leg portions, said first and second leg portions engaging the first and second grooves, respectively, in the actuating member, to orient the actuating member about its longitudinal axis and prevent rotation about said axis, and limit its axial movement to that determined by the difference between the widths of the slot and stop member, measured in the axial direction of the actuating member.

11. The push-button assembly of claim 10 including a third groove in the actuating member which joins and is perpendicular to the first and second grooves, with the bight portion of the stop member engaging said third groove.

12. The push-button assembly of claim 10 wherein the stop member is self-locking on the actuating member, requiring a slight separation of the first and second leg portions to disengage the stop member from the actuating member.

13. The push-button assembly of claim 10 wherein the stop member is configured such that the contact area between the actuating member and the stop member is substantially equal to the contact area between the stop member and the side of the slot in the housing.

* * * * *